United States Patent [19]

Spinner

[11] Patent Number: 4,754,241

[45] Date of Patent: Jun. 28, 1988

[54] 3DB DIRECTIONAL COUPLER

[76] Inventor: Georg Spinner, Am Eichberg 12, 8152 Feldkirchen-Westerham, Fed. Rep. of Germany

[21] Appl. No.: 50,540

[22] Filed: May 14, 1987

[30] Foreign Application Priority Data

May 23, 1986 [DE] Fed. Rep. of Germany ..... 3617359

[51] Int. Cl.[4] ..... H01P 5/18

[52] U.S. Cl. ..... 333/111; 333/116

[58] Field of Search ..... 333/115, 116, 111

[56] References Cited

U.S. PATENT DOCUMENTS

| | | | |
|---|---|---|---|
| 3,166,723 | 1/1965 | Bock et al. | 333/111 |
| 3,363,201 | 1/1968 | Isaacson | 333/111 |
| 4,539,534 | 9/1985 | Hudspeth et al. | 333/115 |

*Primary Examiner*—Paul Gensler

*Attorney, Agent, or Firm*—Henry M. Feiereisen

[57] ABSTRACT

A 3dB directional coupler includes a housing accommodating two spaced apart coupling lines connecting the inner conductors of coaxial lines and coupled to each other via a coupling aperture in a partition wall which extends in said housing. The housing is thus divided into two housing parts whose cross section is defined by a long side and a short side the difference of which substantially corresponds to the width of each coupling line while the cross sectional circumference of each coupling line corresponds essentially to the circumference of the inner conductors. Outside the coupling path, the coupling lines are provided with homogenous sections of sufficient length to reduce field inhomogeneities before the coupling path.

8 Claims, 1 Drawing Sheet

3DB DIRECTIONAL COUPLER

FIELD OF THE INVENTION

The present invention relates to a directional coupler, in particular to a 3 dB directional coupler.

BACKGROUND OF THE INVENTION

From West German publication DE-OS No. 23 26 810, a 3 dB directional coupler is known which includes two parallel coupling lines in the form of strip lines connecting respective inner conductors of coaxial lines and arranged in spaced-apart relationship so as to define a gap therebetween. For controlling the coupling attenuation, the gap is adjusted by pins which engage the center of the coupling path. This directional coupler which is preferably used for power combination or power distribution is not suitable when transmission of considerable power at very short waves is required. When in view of the power to be transmitted the cross section of the line is to be provided of such magnitude that the critical frequency of the line is only slightly above the operating frequency, the coupling path cannot be accurately defined anymore because the extensive dimensions of the strip conductors require in comparison to the operating wave length considerable radii at the junction to the coupling path as will be explained by the following example:

A coaxial line with a wave impedance of 50Ω which is dimensioned for a frequency of 800 MHz and for the maximum transmittable power at this frequency has an outer conductor with a diameter of about 150 mm and an inner conductor with a diameter of 63 mm. The coupling path of the directional coupling has a length of $\lambda/4$ of about 93 mm wherein $\lambda$ is the wavelength at the design frequency.

Such a ratio of the diameter of the inner conductor to the length of the coupling path results in a directional coupler of the above-mentioned kind in which inevitably field distortions and field inhomogeneities occur at the junction of the respective inner conductor of the coaxial line with the strip conductor extending in the area of the coupling path so that the directivity and the frequency response of the directional coupler is deteriorated. A further problem of this known coupler is the obtained bending of the strip conductors when adjusting the coupling attenuation by shifting the pins in axial direction thereof so that parallelism of the strip conductors is not maintained along the coupling path.

SUMMARY OF THE INVENTION

It is thus an object of the present invention to provide an improved directional coupler obviating the aforestated drawbacks.

This object and others which will become apparent hereinafter is attained in accordance with the present invention by providing each of the coupling lines connecting the inner conductors of coaxial lines at a width substantially corresponding to the difference between the length of the long side and the length of the short side of respective housing parts as defined by dividing the housing by a partition wall, and with a cross sectional circumference substantially corresponding to the circumference of the pertaining inner conductor. The coupling lines include homogeneous sections extending along an area between their junction with the pertaining inner conductors and the coupling path which sections are each of a length substantially corresponding to the inner diameter of the outer conductor of the coaxial lines.

Such a directional coupler can be loaded at maximum power which is transmittable via the connected coaxial lines without losses in the directivity and/or frequency response. By providing the coupling lines with homogeneous sections preceding and succeeding the actual coupling path, field distortions are reduced which occur at the junction of the inner conductors of the coaxial lines with the respective coupling lines. By taking into account the critical frequency, wave impedance and the power to be transmitted, the coupling lines are designed as wide as possible and as thin as possible so that exactly defined junctions to the coupling path are obtained. Thus, the bending radii at the junctions are kept small relative to the wave length.

According to another feature of the invention, the section of the coupling line extending along the coupling path is provided more rigidly than the preceding and succeeding homogeneous sections. Thus, when adjusting the distance between the coupling lines along the coupling path and thus adjusting the coupling attenuation e.g. by shifting respective pins, the parallelism of the coupling lines in the area of the coupling path is continuously maintained.

For reducing the reflection factor, it is proposed to provide the homogeneous sections of the coupling lines extending in their respective housing part parallel offset relative to the central plane of the housing parts in direction toward the partition wall. This measure allows an even better approximation of the wave impedance of the directional coupler to the one of the coaxial lines. The degree of the parallel offset arrangement can easily be determined through suitable tests.

BRIEF DESCRIPTION OF THE DRAWING

The above and other objects, features and advantages of the present invention will now be described in more detail with reference to the accompanying drawing in which.

DESCRIPTION OF PREFERRED EMBODIMENTS

Figure 1:
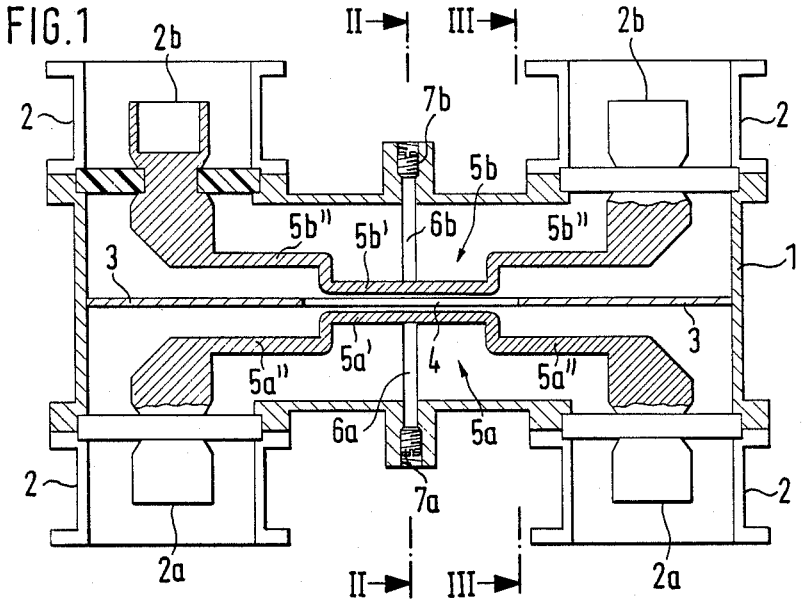
FIG. 1 is a schematic longitudinal section of one embodiment of a directional coupler according to the present invention.

In the drawing, there is shown an exemplified schematic illustration of one embodiment of a directional coupler in accordance with the present invention. The directional coupler includes a rectangular metal housing 1 with a side ratio preferably in the range of about 1 : 2 to 1 : 3. The housing 1 is provided with four connecting terminals 2 for coaxial lines of which the inner conductors *2a, 2b* are shown. In the nonlimiting example of FIG. 1, the terminals 2 are shown perpendicular to the longitudinal axis of the housing 1, however, it is certainly within the scope of the invention to arrange the terminals 2 in any other suitable manner like e.g. at an angle to the longitudinal axis of the housing 1.

Figure 3:
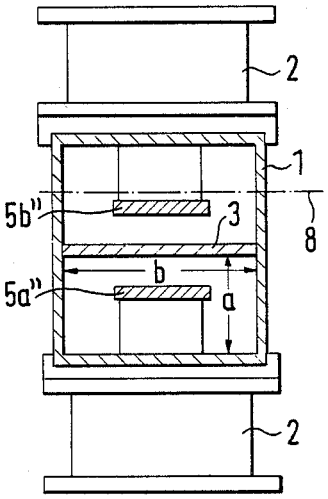
FIG. 3 is a cross sectional view of the directional coupler taken along the line III—III in FIG. 1.

Extending within the housing 1 at a central area thereof is a partition wall 3 which is provided with a coupling aperture 4 of a length of approximately $\lambda/4$. The housing 1 thus includes two rectangular housing parts each defined by a short side a and a long side b (FIG. 3).

While the housing 1 acts as conductor for the outer conductors (not shown) of the coaxial lines, those inner conductors 2*a* and 2*b* which are arranged at the same side of the housing 1 are connected to each other by a strip conductor 5*a*, 5*b* extending in the respective housing parts. Together with the respective portions of the housing 1 and the partition wall 3, the strip conductors 5*a*, 5*b* define strip or coupling lines with a characteristic wave impedance corresponding to the one of the linked coaxial lines.

As is shown especially in FIG. 1, each strip line is essentially subdivided in three sections, that is a central coupling section 5*a*', 5*b*' and two corresponding lateral sections 5*a*'', 5*b*'' respectively connected to the coupling section 5*a*', 5*b*' at each side thereof. In the area of the coupling aperture 4, the strip conductors 5*a*, 5*b* are angled toward each other so that the central coupling sections 5*a*', 5*b*' extend juxtaposed and parallel to each other along the coupling aperture 4 and define a coupling gap therebetween. This area is the actual coupling path.

The lateral sections 5*a*'', 5*b*'' which extend beyond the coupling path define with the walls of the metal housing 1 and the partition wall 3 homogeneous strip lines (see FIG. 3) of a sufficient length, preferably of a length essentially corresponding to the inner diameter of the outer conductor of the coaxial lines so that field inhomogeneities caused at the junction from the inner conductors 2*a*, 2*b* to the pertaining strip conductors 5*a*, 5*b* are reduced before the coupling path.

For allowing an adjustment of the coupling gap and thus of the coupling attenuation, pins 6*a* and 6*b* of insulating material engage the coupling sections 5*a*', 5*b*' at their side remote to the coupling opening 4. Preferably, these adjusting pins 6*a*, 6*b* act on the coupling sections 5*a*', 5*b*' at the center thereof. Cooperating with the pins 6*a*, 6*b* are grub screws 7*a*, 7*b* which upon rotation shift the pins 6*a*, 6*b* in axial direction thereof.

Figure 2:
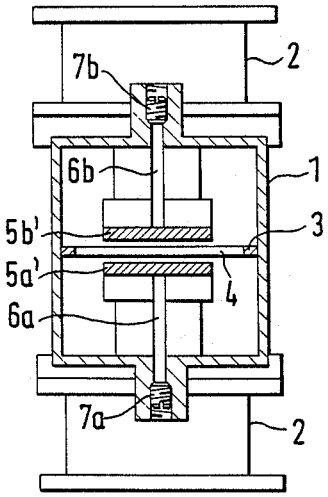
FIG. 2 is a cross sectional view of the directional coupler taken along the line II—II in FIG. 1.

Turning now in particular to FIGS. 2 and 3, it can be seen that the strip conductors 5*a*, 5*b* are dimensioned in such a manner that their width corresponds essentially to the length of the long rectangular side b of the pertaining housing part reduced by the length of the short rectangular side a thereof so that a maximum power load-carrying capacity is obtained. In addition, each strip conductor 5*a*, 5*b* is defined by a cross sectional circumference which corresponds approximately to the circumference of the inner conductor of the coaxial lines so that the minimum thickness of the strip conductors 5*a*, 5*b* is defined. Preferably, the central coupling sections 5*a*', 5*b*' are of greater thickness and thus more rigid than the lateral sections 5*a*'', 5*b*'' in order to provide a greater flexural strength. Thus, parallelism of the coupling sections 5*a*', 5*b*' is guaranteed when adjusting the pins 6*a*, 6*b* by rotating the scrub screws 7*a*, 7*b* while the non-coupling lateral sections 5*a*'', 5*b*'' of the strip conductors 5*a*, 5*b* perform a respective elastic deformation.

As can be seen especially from FIG. 3, the lateral sections 5*a*'', 5*b*'' of the strip conductors 5*a*, 5*b* extend in the pertaining housing parts of the housing 1 parallel offset by a small portion toward the partition wall 3 relative to the center plane or plane of symmetry 8 of each housing part so as to provide an improved adjustment of the wave impedance of the strip lines to the coaxial lines.

While the invention has been illustrated and described as embodied in a 3 dB Directional Coupler, it is not intended to be limited to the details shown since various modifications and structural change may be made without departing in any way from the spirit of the present invention.

What is claimed as new and desired to be protected by Letters Patent is set forth in the appended claims:

I claim:

1. A 3 dB directional coupler, comprising:

a housing of electrically conductive material and adapted for connection to inner and outer conductors of coaxial lines;

a partition wall for dividing said housing into respective housing parts with a cross section defined by a long side and a short side, said partition wall having a coupling aperture to provide a coupling path; and at least two coupling lines extending in said housing parts for connecting the inner conductors of the coaxial lines and being coupled via said coupling aperture, said coupling lines having a width substantially corresponding to the difference between said long side and said short side of the pertaining one of said housing parts, and having a cross sectional circumference substantially corresponding to the circumference of the pertaining inner conductor, wherein said coupling lines include homogeneous sections extending along an area between their junction with the pertaining inner conductors and said coupling path and being of a length substantially corresponding to the inner diameter of the outer conductor of the coaxial lines.

2. A directional coupler as defined in claim 1 and further comprising adjusting means acting on said coupling lines at a central location of said coupling path for adjusting the coupling attenuation.

3. A directional coupler as defined in claim 1 wherein in the area of said coupling path said coupling lines are of greater thickness than said homogeneous sections so as to increase the flexural strength of said coupling lines along said coupling path.

4. A directional coupler as defined in claim 1 wherein said housing parts define a plane of symmetry parallel to said partition wall, said homogeneous sections of said coupling lines extending parallel offset to said plane of symmetric in the direction of said partition wall.

5. A directional coupler as defined in claim 1 wherein said coupling lines include a central section extending in the area of said coupling aperture, said central sections of said coupling lines extending parallel offset relative to said homogeneous sections so as to be juxtaposed to each other along said coupling path.

6. A directional coupler as defined in claim 1 wherein said housing is of rectangular cross section.

7. A directional coupler as defined in claim 1 wherein said coupling path has a length of about $\lambda/4$ wherein $\lambda$ is the wavelength at the design frequency.

8. A directional coupler as defined in claim 1 wherein said coupling lines are in the form of strip lines.

* * * * *

UNITED STATES PATENT AND TRADEMARK OFFICE

CERTIFICATE OF CORRECTION

PATENT NO. : 4,754,241

DATED : June 28, 1988

INVENTOR(S) : GEORG SPINNER

It is certified that error appears in the above-identified patent and that said Letters Patent is hereby corrected as shown below:

COLUMN 1, LINE 36, change "design" to -- desired --;

CLAIM 7, LINE 3, change "design" to -- desired --.

Signed and Sealed this

Twenty-fifth Day of April, 1989

*Attest:*

DONALD J. QUIGG

*Attesting Officer*

*Commissioner of Patents and Trademarks*